US008490347B2

(12) United States Patent
Valler et al.

(10) Patent No.: US 8,490,347 B2
(45) Date of Patent: Jul. 23, 2013

(54) CORNER JOINT FOR A WINDOW OR DOOR FRAME

(75) Inventors: Jess J. Valler, Olympia, WA (US); Michael Kuneman, Auburn, WA (US)

(73) Assignee: Milgard Manufacturing Incorporated, Tacoma, WA (US)

( * ) Notice: Subject to any disclaimer, the term of this patent is extended or adjusted under 35 U.S.C. 154(b) by 137 days.

(21) Appl. No.: 13/101,813

(22) Filed: May 5, 2011

(65) Prior Publication Data

US 2012/0279166 A1 Nov. 8, 2012

(51) Int. Cl.
*E06B 1/04* (2006.01)

(52) U.S. Cl.
USPC ..... 52/204.1; 52/656.4; 52/204.5

(58) Field of Classification Search
USPC ..... 52/204.1, 204.5, 656.1, 656.5, 656.4
See application file for complete search history.

(56) References Cited

U.S. PATENT DOCUMENTS

| | | | | |
|---|---|---|---|---|
| 3,304,108 | A * | 2/1967 | Hamilton et al. | 403/295 |
| 3,528,692 | A * | 9/1970 | De Vries | 403/37 |
| 3,898,728 | A * | 8/1975 | Rousseau | 29/446 |
| 3,949,526 | A * | 4/1976 | Sherlock et al. | 49/501 |
| 4,024,659 | A * | 5/1977 | Ingerdahl | 40/741 |
| 4,076,438 | A * | 2/1978 | Bos | 403/402 |
| 4,689,933 | A * | 9/1987 | Biro | 52/656.5 |
| 4,899,507 | A * | 2/1990 | Mairlot | 52/222 |
| 5,090,836 | A | 2/1992 | Hwang et al. | |
| 6,067,760 | A | 5/2000 | Nowell | |
| 6,503,020 | B1 | 1/2003 | Mascioletti et al. | |
| 6,746,175 | B1 | 6/2004 | Gonnerman et al. | |
| 7,228,662 | B1 * | 6/2007 | John | 52/204.1 |
| 7,571,574 | B2 | 8/2009 | Yu | |
| 7,614,188 | B2 | 11/2009 | Hetherington et al. | |
| 7,677,003 | B2 | 3/2010 | Baughn et al. | |
| 2001/0014250 | A1 | 8/2001 | Plummer et al. | |
| 2005/0160677 | A1 | 7/2005 | Gepfrey et al. | |
| 2005/0186025 | A1 | 8/2005 | Tzeng | |
| 2005/0193680 | A1 | 9/2005 | Wang | |
| 2008/0034702 | A1 | 2/2008 | Garries et al. | |
| 2008/0202035 | A1 | 8/2008 | Gepfrey et al. | |
| 2008/0216440 | A1 | 9/2008 | Kobayashi | |

* cited by examiner

*Primary Examiner* — Branon Painter
(74) *Attorney, Agent, or Firm* — Reising Ethington PC

(57) ABSTRACT

A corner joint for a window or door frame includes first and second frame members each having a mitered end, at least one cavity in each mitered end and at least one side wall opening into each cavity. A screw boss is disposed in the cavity of the first frame member, and a detent lug on a flexible resilient portion of the screw boss is received in the side wall opening of the first frame member. A corner key has a first leg received in the cavity of the first frame member over the screw boss to hold the screw boss in place, and a second leg received in the cavity of the second frame member. A screw extends through the side wall opening in the second frame member and through the corner key, and is threaded into the screw boss to clamp the mitered ends of the frame members together. A sealing gasket may be captured between the mitered ends of the frame members.

16 Claims, 6 Drawing Sheets

CORNER JOINT FOR A WINDOW OR DOOR FRAME

The present disclosure relates to assembly of a corner joint of a window or door frame employing a corner key that extends into the ends of the frame rail members.

BACKGROUND AND SUMMARY OF THE DISCLOSURE

A general object of the present disclosure is to provide a corner joint for a window or door frame that is easy and economical to assemble, and preferably which seals the ends of the frame members to each other.

The present disclosure embodies a number of aspects that can be implemented separately from or in combination with each other.

A corner joint for a window or door frame, in accordance with one aspect of the present disclosure, includes first and second frame members each having a mitered end, at least one cavity in each mitered end and at least one side wall opening into each cavity. A screw boss is disposed in the cavity of the first frame member, and a detent lug on a flexible resilient portion of the screw boss is received in the side wall opening of the first frame member. A corner key has a first leg received in the cavity of the first frame member over the screw boss to hold the screw boss in place, and a second leg received in the cavity of the second frame member. A screw extends through the side wall opening in the second frame member and through the corner key, and is threaded into the screw boss to clamp the mitered ends of the frame members together. A sealing gasket may be captured between the mitered ends of the frame members.

The detent lug preferably has an angled face to engage the mitered end of the first frame member and cam the flexible resilient portion of the screw boss inwardly during insertion of the screw boss into the first frame member. Registry of the detent lug with the side wall opening in the first frame member allows the flexible resilient portion of the screw boss to snap the detent lug outwardly into the side wall opening thereby securing the screw boss in the first frame member. In different preferred embodiments of the disclosure, the detent lug is disposed on an arm flexibly that is resiliently cantilevered from the screw boss, or on a flexible resilient side wall of the screw boss.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figure 1:
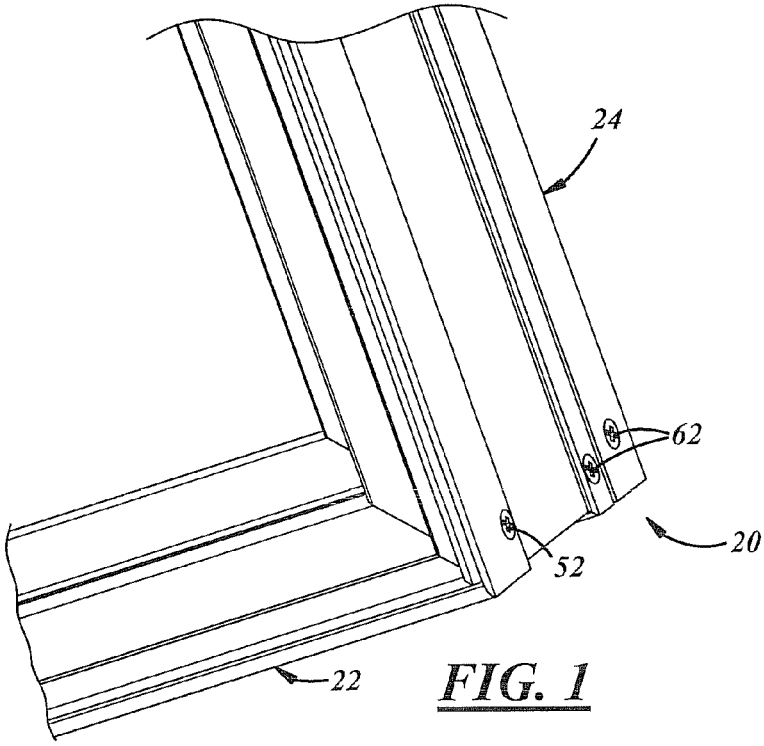
FIG. 1 is a fragmentary perspective view of a corner joint in accordance with one exemplary embodiment of the present disclosure.
Figure 4:
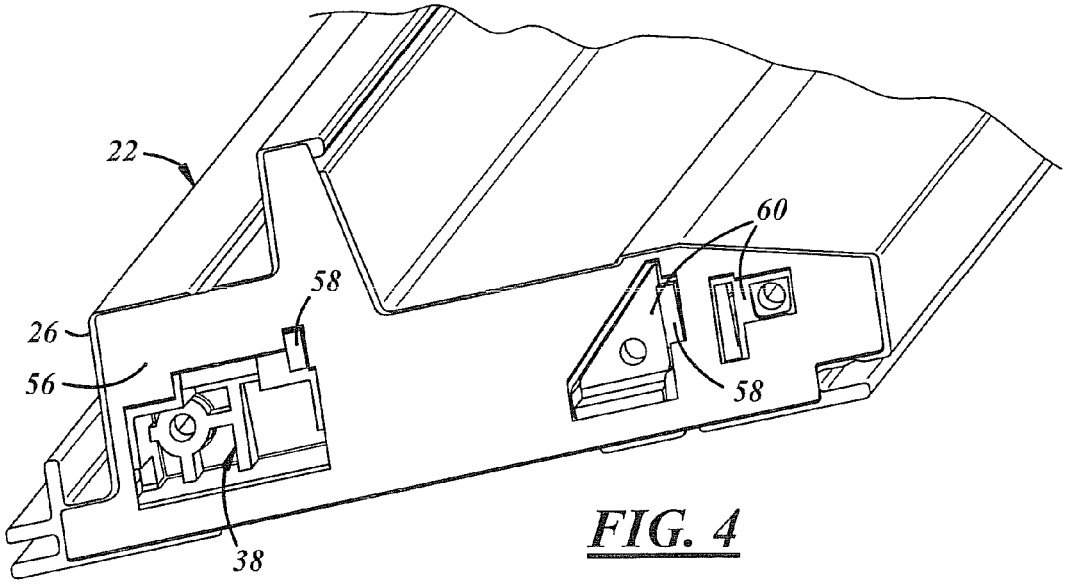
FIG. 4 is an end perspective view of the first frame member in the corner joint of FIGS. 1-3.
Figure 2:
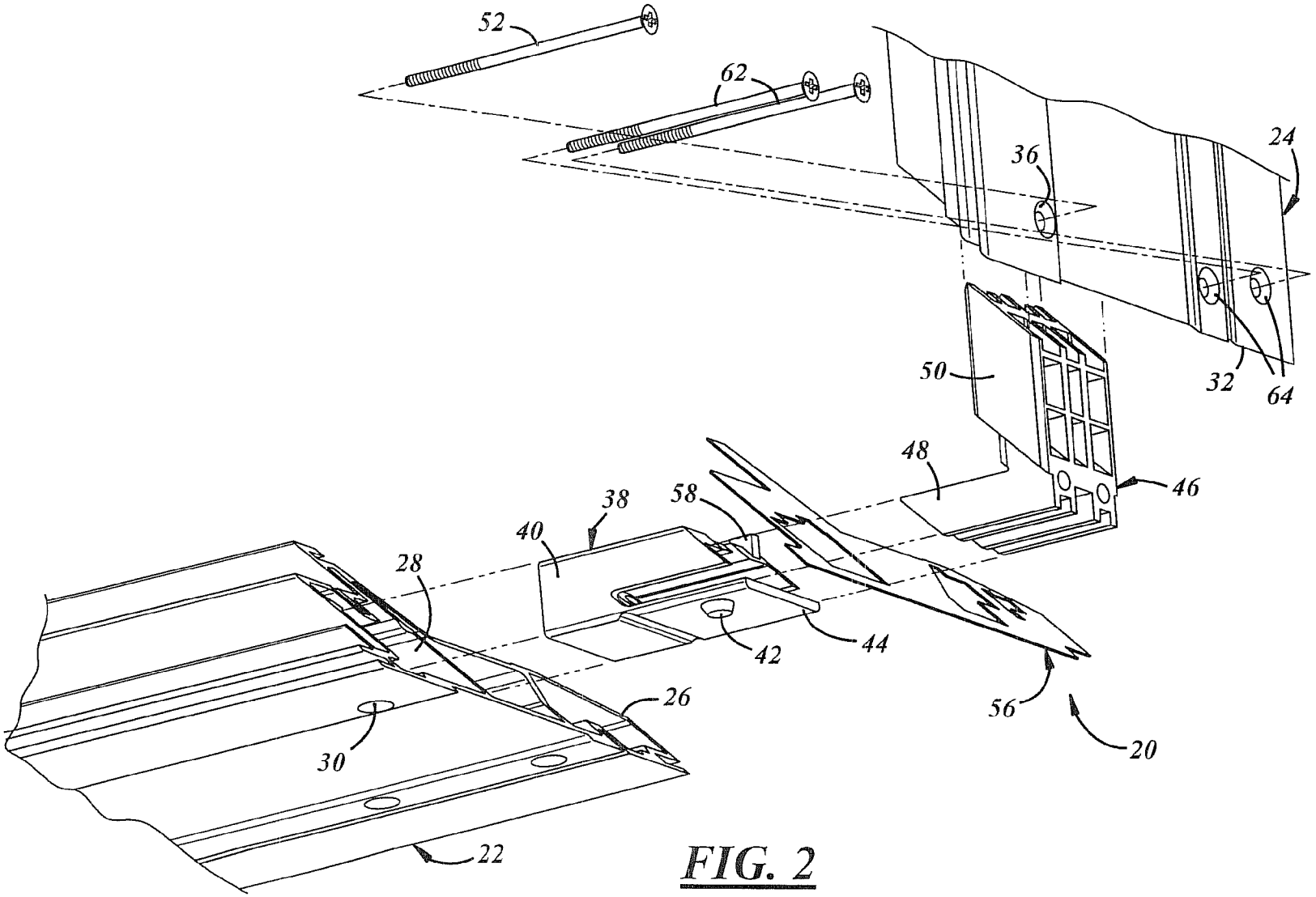
FIG. 2 is an exploded perspective view of the corner joint illustrated in FIG. 1.
Figure 3:
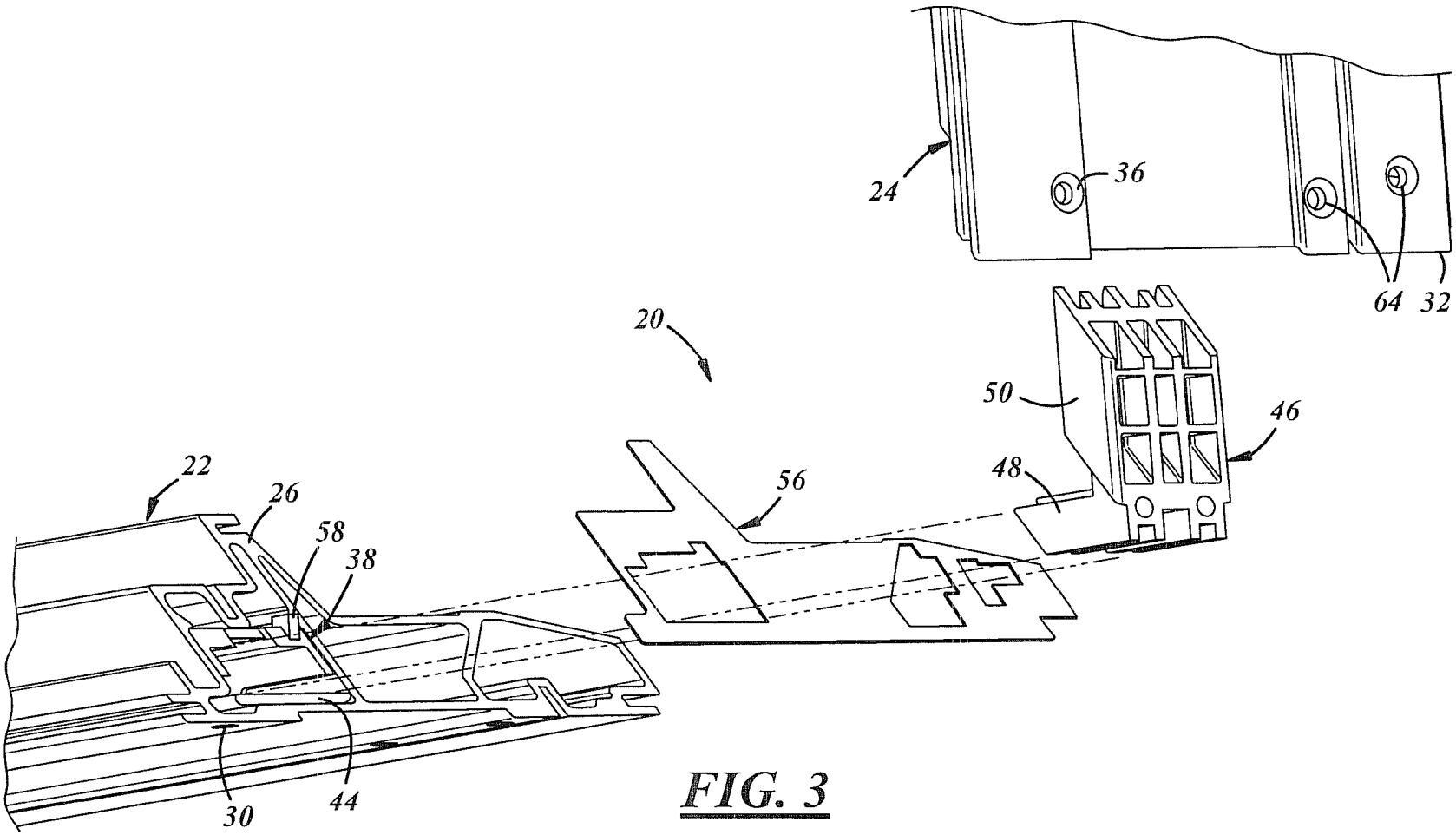
FIG. 3 is a partially assembled exploded perspective view of the corner joint in FIGS. 1 and 2.
Figure 5:
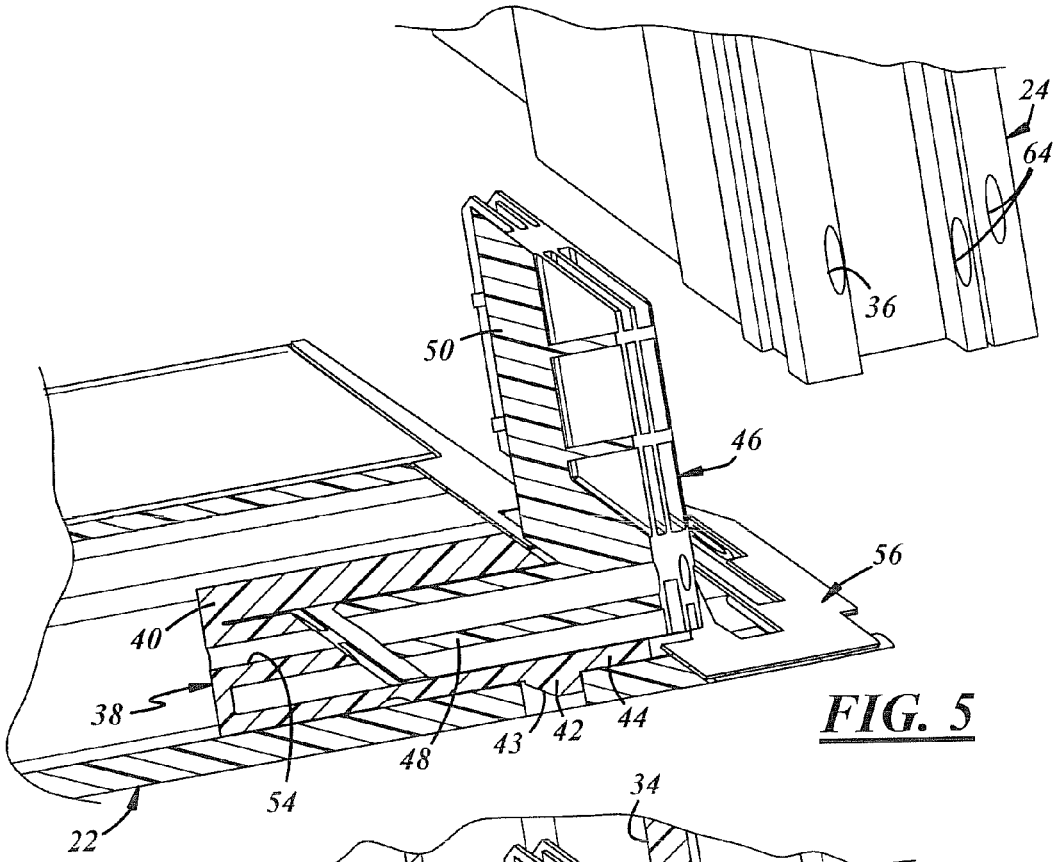
FIG. 5 is a partially sectioned exploded perspective view of the corner joint in FIGS. 1-3.

FIG. 1 illustrates a frame corner joint 20 in accordance with a first exemplary embodiment of the disclosure as including a first frame member 22 assembled to a second frame member 24. Referring collectively to FIGS. 1-6, first frame member 22 has a mitered end 26, which typically presents a planar end face at an angle of 45° with respect to the longitudinal dimension of frame member 22. Frame member 22 has at least one internal cavity 28, and at least one side wall opening 30 into cavity 28. Likewise, second frame member 24 has a mitered end 32, at least one cavity 34 (FIG. 6) in the mitered end and at least one side wall opening 36 into the cavity 34. Frame members 22, 24 preferably are of plastic, wood, aluminum, fiberglass or vinyl construction. The frame members most preferably are of extruded plastic, aluminum, fiberglass or vinyl construction, and cavities 28, 34 extend entirely through the respective frame members 22, 24, opening at the opposing ends of the frame members for assembly of the corner joints at such respective ends.

Figure 6:
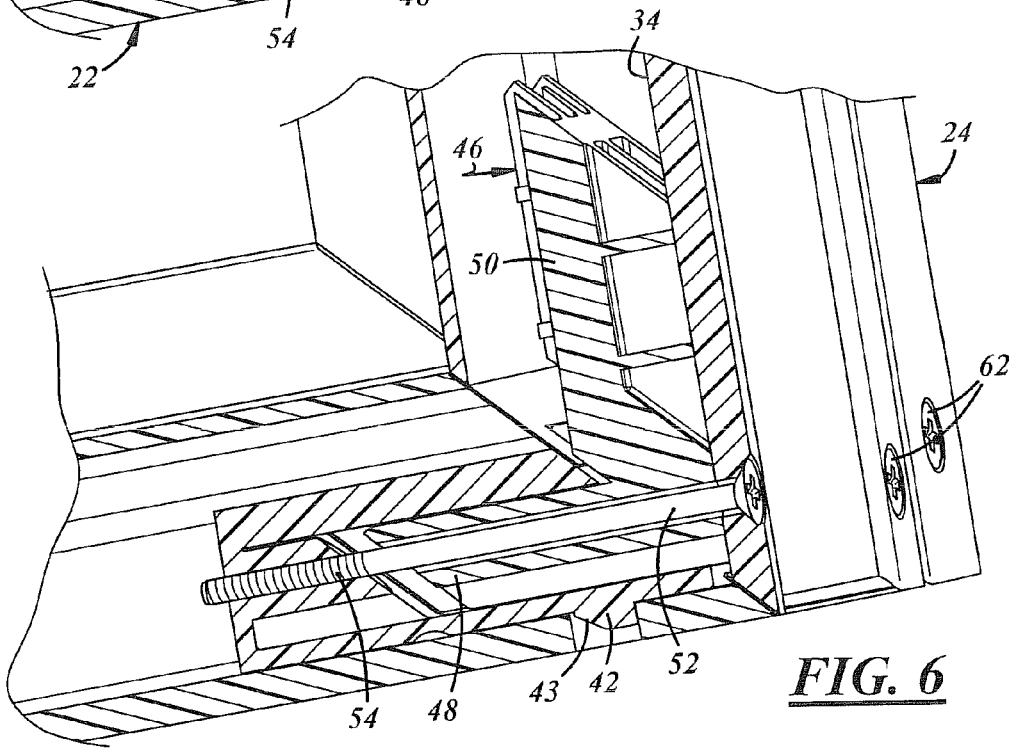
FIG. 6 is a sectional view Of the corner joint assembly in FIG. 1.

A screw boss 38 is disposed in cavity 28 of first frame member 22. Screw boss 38 preferably includes a body 40 having a detent lug 42 disposed on a flexible resilient portion of the screw boss. In the embodiment of FIGS. 1-6, detent lug 42 is disposed on an arm 44 that is flexibly and resiliently cantilevered from body 40 of screw boss 38. Detent lug 42 preferably has an angled side face 43 for engaging the opposing edge of mitered end 26 as screw boss 38 is inserted into cavity 28 to cam lug 42 and arm 44 inwardly against body 40 until detent lug 42 registers with side wall opening 30, at which point the resiliency of arm 44 snaps detent lug 42 into opening 30 to hold screw boss 38 in place. A corner key 46 has a first leg 48 received in cavity 28 of first frame member 22 overlying screw boss 38 so as to capture screw boss 38 within first frame member 22. Corner key 46 also has a second leg 50 received in cavity 28 of second frame member 24 (FIG. 6). A screw 52 extends through side wall opening 36 in second frame member 24, through leg 48 of corner key 46 and is threaded into an opening 54 in body 40 of screw boss 38. Opening 54 can have internal threads preformed therein, or screw 52 can be self-tapping. Screw 52 thus firmly clamps the mitered ends of frame members 22, 24 to each other.

A sealing gasket 56 preferably is positioned between the mitered ends of the frame members prior to assembly so that the sealing gasket is firmly captured between the frame members during assembly. Screw boss 38 preferably has at least one gasket locator 58 formed thereon to help position and hold gasket 56 during the assembly process. Corner key 46 preferably is of one-piece substantially L-shaped construction. Screw boss 38 and corner key 46 can be of any suitable construction such as molded plastic. Gasket 56 can be of any suitable construction.

The exemplary corner joint 20 illustrated in FIGS. 1-6 can have a second screw boss 60 (FIG. 4) laterally spaced from screw boss 38 in a second cavity of first frame member 22, and a pair of screws 62 that extend through side wall openings 64 in second frame member 24 to engage screw boss 60 and stabilize corner joint 20.

Figure 7:
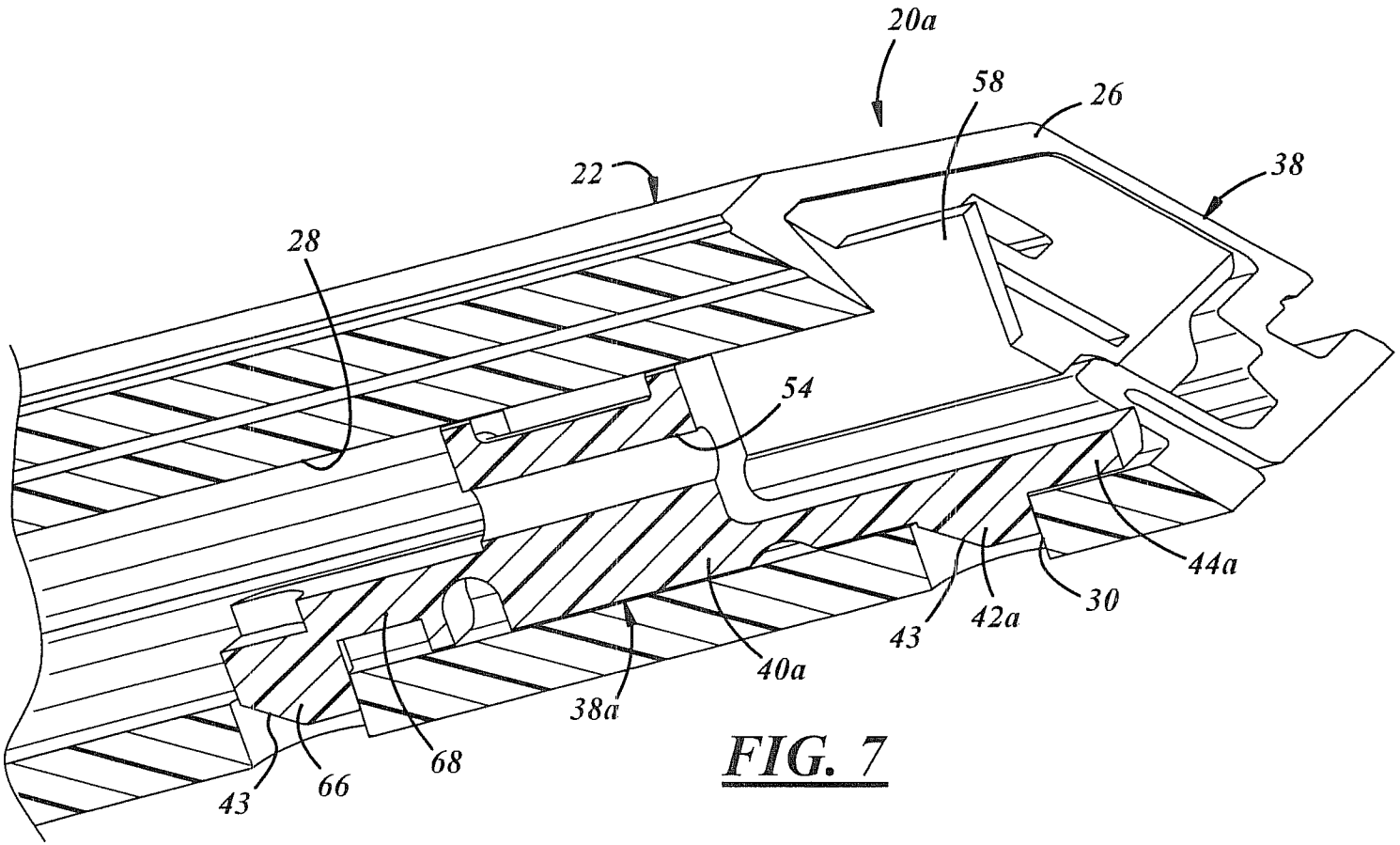
FIG. 7 is a fragmentary sectional view of the first frame rail in a modified embodiment of the present disclosure.

FIG. 7 illustrates a corner joint 20*a* in accordance with a second exemplary embodiment of the disclosure, in which the screw boss 38*a* has a first detent lug 42*a* on a first arm 44*a* extending forwardly from the screw boss body 40*a* as in the embodiment of FIGS. 1-6, and a second detent lug 66 on a flexible resilient arm 68 that extends rearwardly from screw boss body 40*a* into cavity 28. In this embodiment, screw 52 (not shown in FIG. 7) extends through opening 54 a sufficient distance to overlie arm 68 and thereby prevent inward flexure of arm 68 that might disengage detent lug 66.

Figure 9:
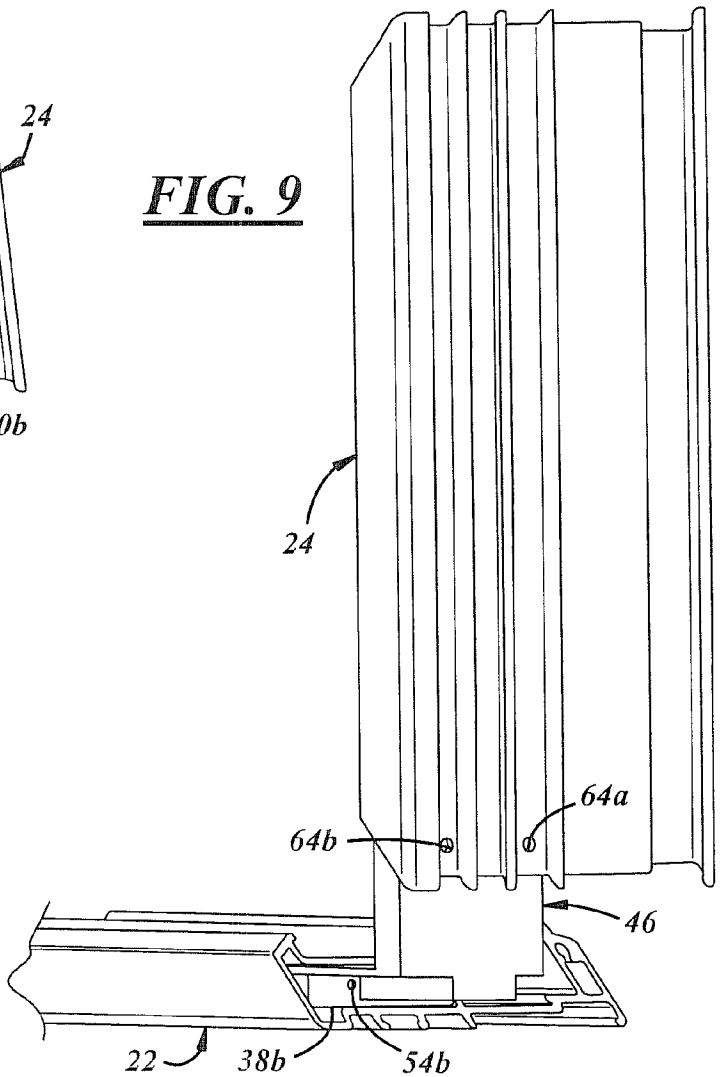
FIGS. 8 and 9 are fragmentary perspective views of a frame corner joint in accordance with a further exemplary embodiment of the disclosure.
Figure 8:
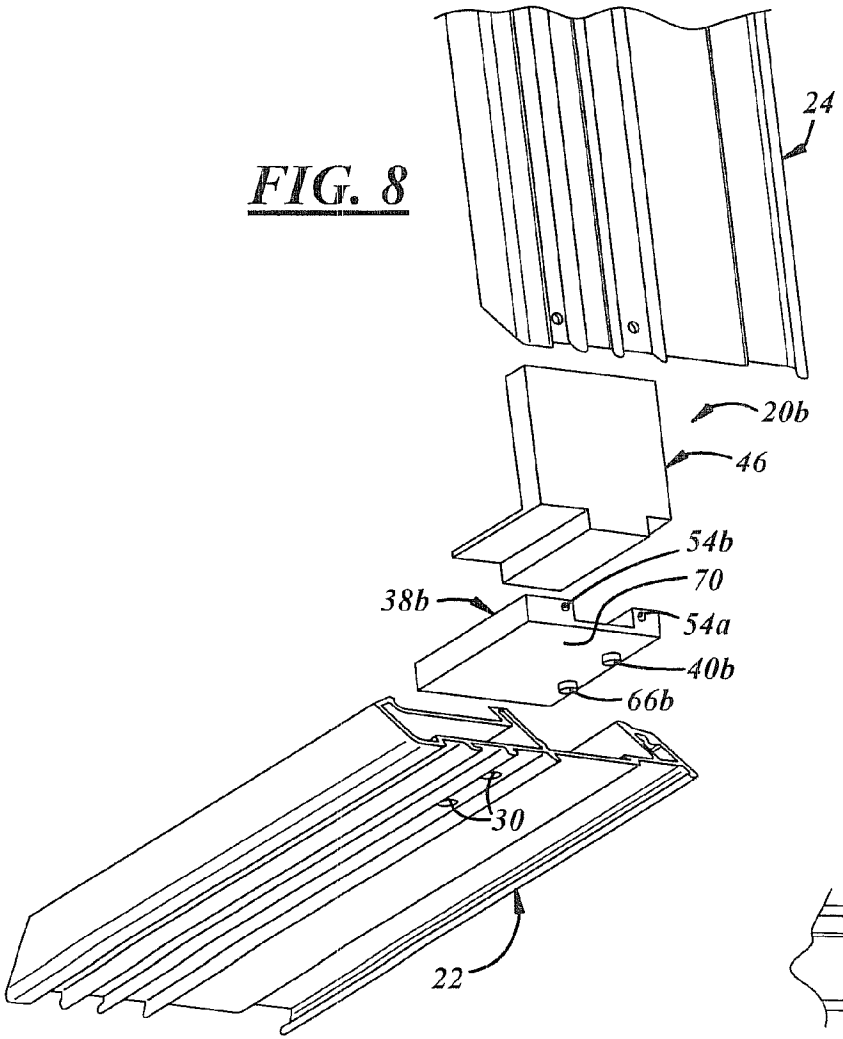

FIGS. 8 and 9 illustrate an exemplary corner joint 20*b*, in which a pair of detent lugs 40*b*, 66*b* are positioned on a flexible resilient wall 70 of screw boss 38*b*. In this embodiment, there are a pair of screw-receiving openings 54*a*, 54*b* in screw boss 38*b*, which receive respective assembly screws (not shown) through side wall openings 64*a*, 64*b* in frame member 24. Corner joint 20*b* in FIGS. 8-9 otherwise is similar to the corner joints previously described.

There thus has been disclosed a corner joint for a window or door frame that fully satisfies all of the objects and aims previously set forth. The corner joint of the present disclosure has been disclosed in conjunction with a number of exemplary embodiments, and additional modifications and variations have been discussed. Other modifications and variations readily will suggest themselves to persons of ordinary skill in the art in view of the foregoing discussion. The disclosure is intended to embrace all such modifications and variations as fall within the spirit and broad scope of the appended claims.

The invention claimed is:

1. A corner joint for a window or door frame, which includes:

a first frame member having a mitered end, at least one cavity in said mitered end and at least one side wall opening into said cavity, a second frame member having a mitered end, at least one cavity in said mitered end and at least one side wall opening into said cavity, a screw boss in said cavity of said first frame member, a detent lug on a flexible resilient portion of said screw boss and received in said side wall opening of said first frame member, a corner key having a first leg received in said cavity of said first frame member over said screw boss and holding said screw boss in said first frame member, and a second leg received in said cavity of said second frame member, and a screw extending through said side wall opening in said second frame member and through said corner key, and threaded into said screw boss to clamp said mitered ends of said frame members together.

2. The corner joint set forth in claim 1 including a sealing gasket captured between said mitered ends.

3. The corner joint set forth in claim 2 wherein said screw boss has at last one gasket locator to engage said gasket and hold said gasket in position during assembly of said corner joint.

4. The corner joint set forth in claim 1 wherein said detent lug has an angled face to engage said mitered end of said first frame member and to cam said flexible resilient portion inwardly during insertion of said screw boss into said first frame member, registry of said detent lug with said side wall opening in said first frame member allowing said flexible resilient portion of said screw boss to snap said detent lug outwardly into said side wall opening.

5. The corner joint set forth in claim 4 wherein said detent lug is on an arm flexibly and resiliently cantilevered from said screw boss.

6. The corner joint set forth in claim 5 wherein said screw extends through said screw boss to overlie said arm within said cavity in said first frame member and prevent inward flexure of said arm.

7. The corner joint set forth in claim 4 wherein said detent lug is on a flexible resilient side wall of said screw boss.

8. The corner joint set forth in claim 1 wherein said first and second frame members are of plastic, wood, aluminum, fiberglass or vinyl construction.

9. The corner joint set forth in claim 1 wherein said first and second frame members are of extruded plastic, aluminum, fiberglass or vinyl construction.

10. A corner joint for a window or door frame, which includes:

first and second frame members each having a mitered end, at least one cavity in said mitered end and at least one side wall opening into said cavity, a screw boss in said cavity of said first frame member, and a detent lug on a flexible resilient portion of said screw boss and received in said side wall opening of said first frame member, an L-shaped corner key having a first leg received in said cavity of said first frame member over said screw boss and holding said screw boss in said first frame member, and a second leg received in said cavity of said second frame member, a sealing gasket, and a screw extending through said side wall opening in said second frame member and through said corner key, and threaded into said screw boss to clamp said mitered ends of said frame members together with said sealing gasket captured therebetween, said detent lug having an angled side face to engage said mitered end of said first frame member and cam said flexible resilient portion inwardly during insertion of said screw boss into said first frame member, registry of said detent lug with said side wall opening in said first frame member allowing said flexible resilient portion of said screw boss to snap said detent lug outwardly into said side wall opening.

11. The corner joint set forth in claim 10 wherein said screw boss has a gasket locator to engage said gasket and hold said gasket in position during assembly of said corner joint.

12. The corner joint set forth in claim 10 wherein said detent lug is on an arm flexibly and resiliently cantilevered from said screw boss.

13. The corner joint set forth in claim 12 wherein said screw extends through said screw boss to overlie said arm within said cavity of said first frame member and prevent inward flexure of said arm and disengagement of said detent lug from said side wall opening.

14. The corner joint set forth in claim 10 wherein said detent lug is on a flexible resilient side wall of said screw boss.

15. The corner joint set forth in claim 10 wherein said first and second frame members are of plastic, wood, aluminum, fiberglass or vinyl construction.

16. The corner joint set forth in claim 10 wherein said first and second frame members are of extruded plastic, aluminum, fiberglass or vinyl construction.

* * * * *